US008870322B2

(12) United States Patent
Martin et al.

(10) Patent No.: US 8,870,322 B2
(45) Date of Patent: Oct. 28, 2014

(54) CALIBRATING A PROGRAM THAT DETECTS A CONDITION OF AN INKJET NOZZLE

(75) Inventors: Eric T. Martin, Corvallis, OR (US); Andrew L. Van Brooklin, Corvallis, OR (US); David Maxfield, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 111 days.

(21) Appl. No.: 13/450,651

(22) Filed: Apr. 19, 2012

(65) Prior Publication Data

US 2013/0278657 A1 Oct. 24, 2013

(51) Int. Cl.
*B41J 29/38* (2006.01)

(52) U.S. Cl.
USPC ..... 347/14; 347/5; 347/9; 347/19

(58) Field of Classification Search
CPC ..... B41J 29/38
See application file for complete search history.

(56) References Cited

U.S. PATENT DOCUMENTS

| | | | | |
|---|---|---|---|---|
| 6,460,964 | B2 * | 10/2002 | Osborne | 347/19 |
| 7,029,085 | B2 * | 4/2006 | Yokouchi | 347/11 |
| 7,854,490 | B2 * | 12/2010 | Snyder | 347/19 |
| 8,388,096 | B2 * | 3/2013 | Chee et al. | 347/19 |
| 2009/0040258 | A1 * | 2/2009 | Baek | 347/17 |
| 2010/0033539 | A1 * | 2/2010 | Silverbrook et al. | 347/61 |
| 2011/0084997 | A1 * | 4/2011 | Chen et al. | 347/14 |

* cited by examiner

*Primary Examiner* — Manish S Shah
*Assistant Examiner* — Jeremy Delozier

(57) ABSTRACT

A method for calibrating a program that detects a condition of an inkjet nozzle includes receiving measurement information from a sensor positioned to detect a drive bubble in an ink chamber of an inkjet nozzle; and modifying a program that determines a condition of said inkjet nozzle.

20 Claims, 6 Drawing Sheets

CALIBRATING A PROGRAM THAT DETECTS A CONDITION OF AN INKJET NOZZLE

BACKGROUND

In inkjet printing, ink droplets are released from an array of nozzles in a print head onto a printing medium, such as paper. The ink bonds to a surface of the printing medium and forms graphics, text, or other images. The ink droplets are released with precision to ensure that the image is accurately formed. Generally, the medium is conveyed under the print head while the droplets are selectively released. The medium's conveyance speed is factored into the droplet release timing.

Some inkjet printers include print heads that slide laterally across a swath, or width, of the printing medium during a print job. Other inkjet printers include print heads that remain stationary throughout a printing job. In these printers, an array of nozzles generally spans the entire swath of the printing medium.

Print heads typically include a number of ink chambers, also known as firing chambers. Each ink chamber is in fluid communication with one of the nozzles in the array and provides the ink to be deposited by that respective print head nozzle. Prior to a droplet release, the ink in the ink chamber is restrained from exiting the nozzle due to capillary forces and/or back pressure acting on the ink within the nozzle passage. The meniscus, which is a surface of the ink that separates the liquid ink in the chamber from the atmosphere located below the nozzle, is held in place due to a balance of the internal pressure of the chamber, gravity, and the capillary forces. The size of the nozzle passage is a contributing factor to the strength of the capillary forces. The internal pressure within the ink chamber is generally insufficient to exceed the strength of the capillary forces, and thus, the ink is prevented from exiting the ink chamber through the nozzle passage without actively increasing the pressure within the chamber.

During a droplet release, ink within the ink chamber is forced out of the nozzle by actively increasing the pressure within the chamber. Some print heads use a resistive heater positioned within the chamber to evaporate a small amount of at least one component of the liquid ink. In many cases, a major component of the liquid ink is water, and the resistive heater evaporates the water. The evaporated ink component or components expand to form a gaseous drive bubble within the ink chamber. This expansion exceeds the restraining force enough to expel a single droplet out of the nozzle. Generally, after the release of the single droplet, the pressure in the ink chamber drops below the strength of the restraining force and the remainder of the ink is retained within the chamber. Meanwhile, the drive bubble collapses and ink from a reservoir flows into the ink chamber replenishing the lost ink volume from the droplet release. This process is repeated each time the print head is instructed to fire.

BRIEF DESCRIPTION OF THE DRAWINGS

The accompanying drawings illustrate various examples of the principles described herein and are a part of the specification. The illustrated examples are merely examples and do not limit the scope of the claims.

DETAILED DESCRIPTION

As used herein, a drive bubble is a bubble formed from within an ink chamber to dispense a droplet of ink as part of a printing job or a servicing event. The drive bubble may be made of a vaporized ink separated from liquid ink by a bubble wall. The timing of the drive bubble formation may be dependent on the image to be formed on the printing medium.

The present specification describes subject matter including, for example, a method for modifying a program for determining an inkjet nozzle condition. Examples of such a method include receiving measurement information from a sensor positioned to detect a drive bubble in an ink chamber of an inkjet nozzle and modifying a program that determines a condition of the inkjet nozzle. Calibrating the program may account for differences in drive bubble life spans, formation times, collapse times, and other drive bubble parameters. The differences may be caused by manufacturing variability, changes to the nozzle over the nozzle's life span, use of inks with different properties, other variations, or combinations thereof.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Figure 1:
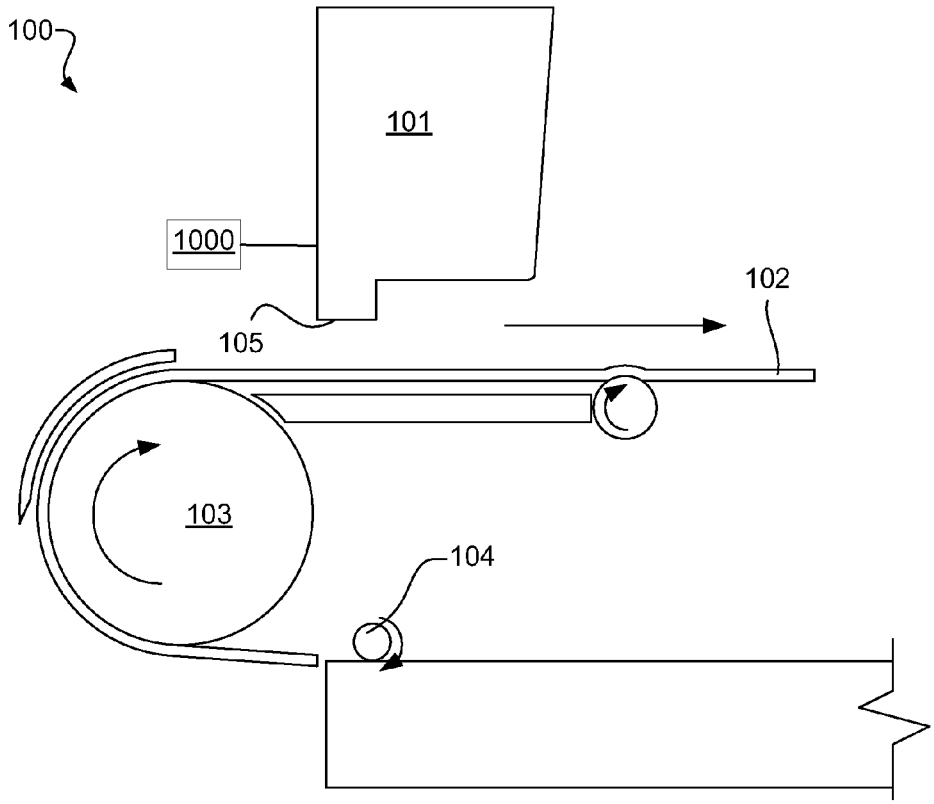
FIG. 1 is a diagram of illustrative components of a printer, according to principles described herein.

FIG. 1 is a diagram of illustrative components of a printer (100), according to principles described herein. In this example, the printer (100) includes a print head (101) positioned over a printing medium (102) traveling through the printer (100).

The printing medium (102) is pulled from a stack of media individually through the use of rollers (103, 104). In other examples, the printing medium is a continuous sheet or web. The printing medium may be paper, but is not limited to cardstock, poster board, vinyl, translucent graphics medium, other printing media, or combinations thereof. The printer (100) further comprises a processor (1000) that is in communication with the print head (101) and is programmed to calibrate a program that determines what issues the print head (101) is experiencing based, for example, on impedance measurements from the nozzles of the print head (101), as will be described in further detail below.

The print head (101) may have a number of nozzles formed in its underside (105). Each nozzle may be in electrical communication with a processor that instructs the nozzles to fire at specific times by activating a heater within the ink chambers associated with each nozzle. The heater may be a heating element, resistive heater, a thin-film resistor, other mechanism that may create a bubble within the ink chamber, or combinations thereof. In other examples, a piezo-electric element may create pressure in the ink chamber to file a desired nozzle.

Figure 2:
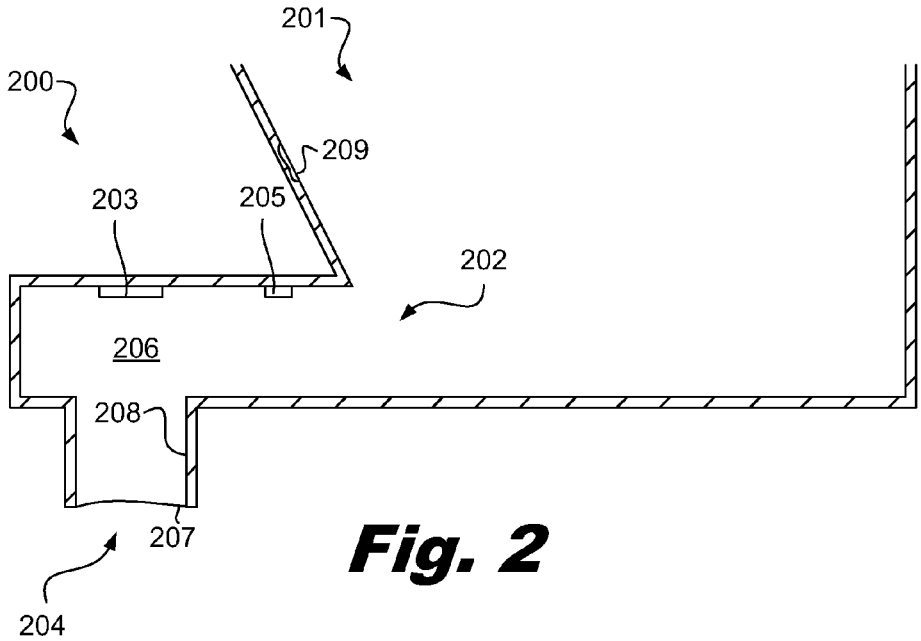
FIG. 2 is a cross sectional diagram of an illustrative ink chamber, according to principles described herein.

FIG. 2 is a cross sectional diagram of an illustrative ink chamber (200), according to principles described herein. In this example, the ink chamber (200) is connected to an ink reservoir (201) through an inlet (202). A heater (203) is positioned over the nozzle (204). An impedance sensor (205) is positioned near the heater (203). Capillary forces cause the ink to form a meniscus (207) within a passage (208) of the nozzle (204). The meniscus is a barrier between the liquid ink (206) in the chamber (200) and the atmosphere located below the nozzle (204). The internal pressure within the ink chamber (200) is not sufficient to move ink out of the chamber (200) unless the chamber's internal pressure is actively increased.

The impedance sensor (205) may have a plate made of a material of a predetermined resistance. In some examples, the plate is made of metal, tantalum, copper, nickel, titanium, or combinations thereof. In some examples, the material is capable of withstanding corrosion due to the material's contact with the liquid ink (206). A ground element (209) may also be located anywhere within the ink chamber (200) or ink reservoir (201). In the example of FIG. 2, the ground element (209) is in the ink reservoir (201). In some examples, the ground element is an etched portion of a wall with a grounded, electrically conductive material exposed. In other examples, the ground element (209) is a grounded electrical pad. When in the presence of liquid ink (206), a voltage is applied to the impedance sensor (205), an electrical current may pass from the impedance sensor (205) to the ground element (209).

The liquid ink (206) may be more conductive than the air or other gasses in the drive bubble. In some examples, the liquid ink contains partly aqueous vehicle mobile ions. In such examples, when a portion of the sensor's surface area is in contact with the liquid ink (206) and when a current pulse or voltage pulse is applied to the sensor (205), the sensor's impedance is lower than it would otherwise be without the ink's contact. On the other hand, when an increasingly larger amount of the sensor's surface area is in contact with the gases of a drive bubble and a voltage or current of the same strength is applied to the sensor (205), the sensor's impedance increases. The sensor (205) may be used to make a measurement of some component of impedance, such as the resistive (real) components at a frequency range determined by the type of voltage source supplying the voltage or current to the sensor. In some examples, a cross sectional geometry of the drive bubble or stray bubbles along the electrical path between the impedance sensor (205) and the ground element (209) may also affect the impedance value.

FIGS. 3-6 depict an illustrative inkjet nozzle with a healthy condition during an ink droplet release. A healthy inkjet nozzle is a nozzle that is associated with an ink chamber, heater, and other components that are free of issues that would cause the nozzle to fire improperly. An improperly firing nozzle includes a nozzle that fails to fire at all, fires early, fires late, releases too much ink, releases too little ink, or combinations thereof.

FIGS. 3-6 depict the stages of the drive bubble from its formation to its collapse. These depictions are merely illustrative. Bubble size and geometry are determined by the factors such as an amount of heat generated by the heater, the internal pressure of the ink chamber, the amount of ink in the ink reservoir, the viscosity of the liquid ink, the ion concentration of the ink, the geometry of the ink chamber, volume of the ink chamber, the diameter size of the nozzle passage, the position of the heater, other factors, or combinations thereof.

Figure 3:
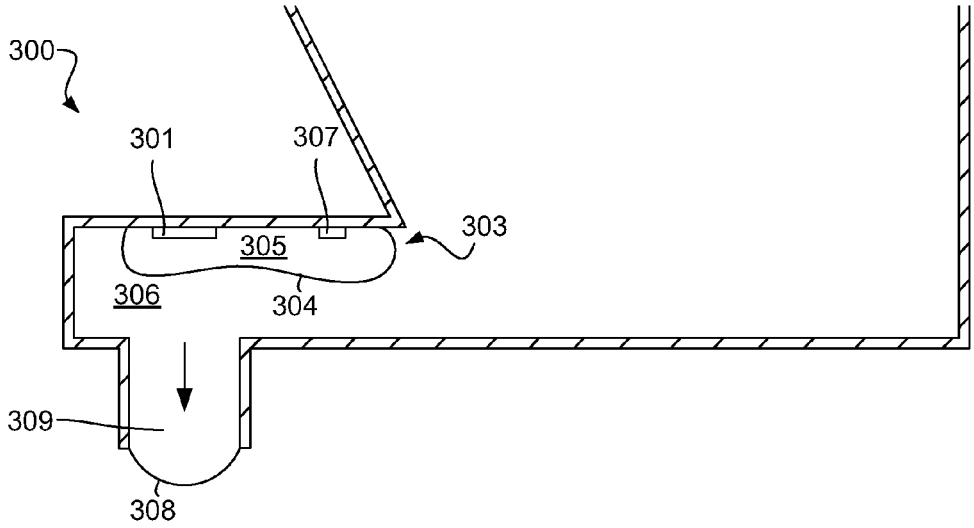
FIG. 3 is a cross sectional diagram of an illustrative ink chamber, according to principles described herein.

FIG. 3 is a cross sectional diagram of an illustrative ink chamber (300), according to principles described herein. In FIG. 3, a heater (301) in the ink chamber (300) is initiating drive bubble formation. A voltage is applied to the heater (301), and the heater's material resists the associated current flow driven by the voltage resulting in Joule heating. This heats the heater's material to a temperature sufficient to evaporate liquid ink in contact with the heater (301). As the ink evaporates, the ink in gaseous form expands forming a drive bubble (303). A bubble wall (304) separates the bubble's gas (305) from the liquid ink (306). In FIG. 3, the drive bubble (303) has expanded to such a volume that the heater (301) and the sensor (307) make physical contact just with the bubble's gas (305). Since the sensor is in contact with the bubble's gas (305), the sensor (307) measures an impedance value that indicates the drive bubble (303) is in contact with the sensor (307).

The expansion of the drive bubble (303) increases the internal pressure of the ink chamber (300). At the drive bubble size depicted in FIG. 3, the chamber's internal pressure displaces enough ink to force the meniscus (308) within the nozzle's passage (309) to bow outward. However, at this stage, inertia continues to keep all of the liquid ink (306) together.

Figure 4:
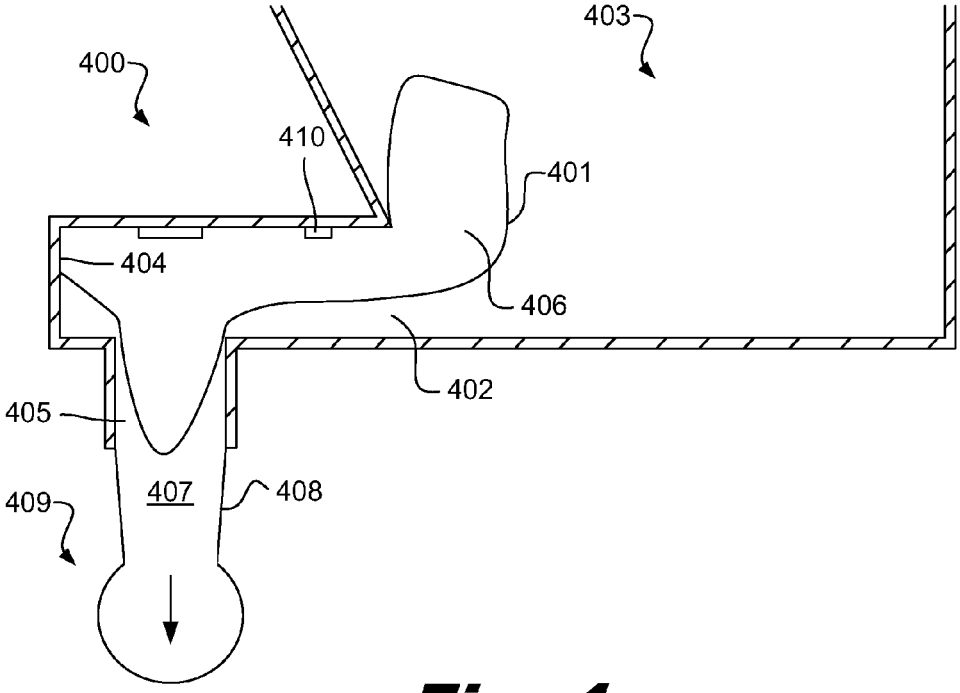
FIG. 4 is a cross sectional diagram of an illustrative ink chamber, according to principles described herein.

FIG. 4 is a cross sectional diagram of an illustrative ink chamber (400), according to principles described herein. In this figure, more time has passed from the initiation of the drive bubble, and the drive bubble's volume has continued to increase. At this stage, the drive bubble wall (401) extends through a chamber inlet (402) into an ink reservoir (403). On the other side of the chamber, the bubble wall (401) makes contact with the chamber's far wall (404). Another portion of the bubble wall (401) enters into the nozzle passage (405).

The drive bubble (406) may substantially isolate the liquid ink (407) in the chamber passage (405) from the rest of the ink chamber (400). As the drive bubble (406) continues to expand into the nozzle passage (405), the pressure in the nozzle passage (405) increases to such a degree that the liquid ink (407) in the passage (405) pushes the meniscus (408) out of the nozzle passage (405) increasing the meniscus's surface area. As the meniscus (408) increases in size, a droplet (409) forms that pulls away from the passage (405).

At this stage, the drive bubble (406) continues to cover the entire surface area of the sensor (410). Thus, the sensor (410) may measure the drive bubble's presence by measuring a higher resistance or impedance that the sensor (410) would otherwise measure if the sensor (410) were in contact with liquid ink (407).

Figure 5:
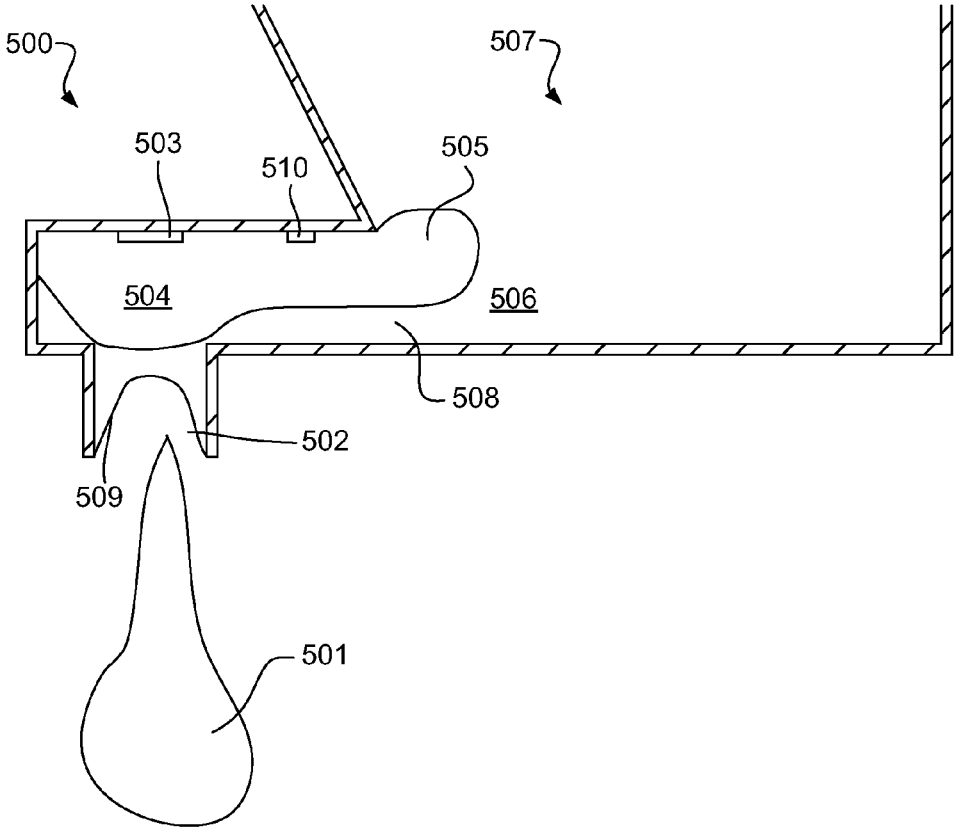
FIG. 5 is a cross sectional diagram of an illustrative ink chamber, according to principles described herein.

FIG. 5 is a cross sectional diagram of an illustrative ink chamber (500), according to principles described herein. In this example, the ink droplet (501) is breaking free from the nozzle passage (502) and the heater (503) is deactivating.

At this stage, the gas (504) of the drive bubble (505) cools in the absence of the heat from the heater (503). As the gas (504) cools, the drive bubble (505) shrinks, which depressurizes the ink chamber (500). The depressurization pulls liquid ink (506) from the ink reservoir (507) into chamber (500) through the chamber inlet (508) to replenish the ink volume lost to the droplet release. Also, the meniscus (509) is pulled back into nozzle passage (502) due to the depressurization.

The sensor (510) continues to measure a comparatively high impedance value because the drive bubble (505) continues to isolate the sensor (510) from the liquid ink (506).

Figure 6:
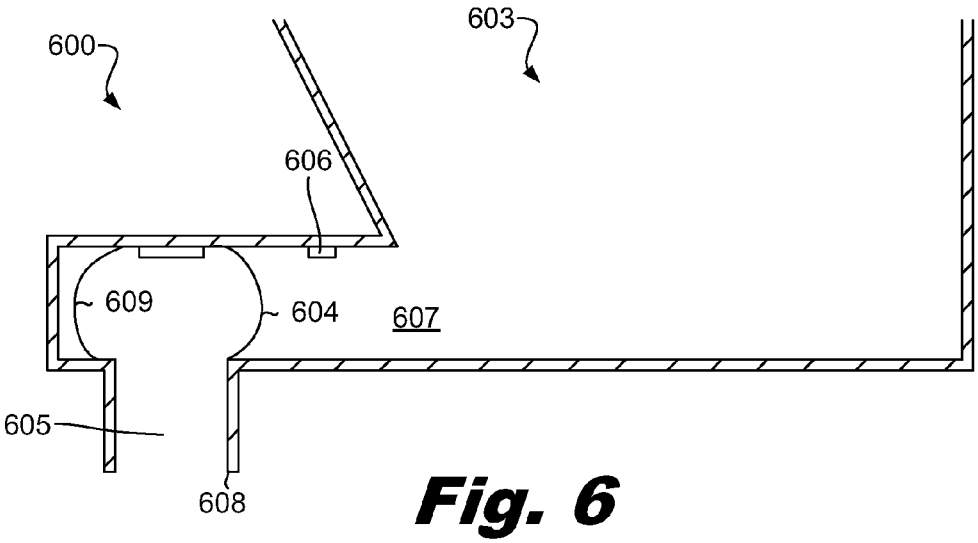
FIG. 6 is a cross sectional diagram of an illustrative ink chamber, according to principles described herein.

FIG. 6 is a cross sectional diagram of an illustrative ink chamber (600), according to principles described herein. In this figure, the drive bubble merges with the meniscus. As the internal pressure of the ink chamber (600) increases due to the ink flow from the reservoir (603), the bubble wall (604) is forced back towards the nozzle passage (605). During this bubble wall retraction, the reservoir side bubble wall (604) pulls away from the sensor (606). As the sensor (606) reestablishes contact with the liquid ink (607), the sensor measures a lower impedance value due to the higher electrical conductivity of the liquid ink (607).

At this stage under healthy operating conditions, the reservoir side bubble wall (604) resists a greater amount of pressure than the far bubble wall (609) due to the ink flow from the ink reservoir (603) reestablishing a pressure equilibrium in the ink chamber (600). The ink flow replenishes the lost ink volume, and the meniscus moves to the end (608) of the nozzle passage (605).

Again, FIGS. 3-6 depict an example of an illustrative inkjet nozzle with a healthy condition during an ink droplet release. However, many conditions may adversely affect the droplet release. For example, a blockage of the nozzle passage may prevent the formation of an ink droplet. The measurement results when a nozzle is blocked in this way may show that the drive bubble forms normally, but that the drive bubble collapses more slowly than expected.

In other examples, a blockage of the ink chamber inlet prevents ink from flowing from the ink reservoir to reestablish equilibrium within the ink chamber. In such a situation, the liquid ink may fail to come back into contact with the sensor. In other cases the ink never enters the chamber during the priming process.

Blockages in either the inlet or nozzle passage may occur due to particles in the ink or solidified portions of the ink. The ink may solidify from exposure to air in the nozzle passage or from heating from the heater. Generally, ink chambers have a volume in the picoliter scale, thus, very small particles may partially or completely form blockages within the ink chamber.

In some cases, liquid ink may dry and solidify on the heater and become a thermal barrier that inhibits the heater's ability to vaporize the liquid ink. The thermal barrier may completely hinder the heater's ability to form a drive bubble or limit the heater to forming a smaller, weaker drive bubble than desired.

Also, the presence of a stray bubble may affect the ink droplet release. Since droplet release timing effects the accuracy of the image formed on the printing medium, the latency from initiating the drive bubble formation to the actual droplet release needs to be predictable. Sometimes air bubbles form in either the body of the ink in the ink reservoir or in the chamber itself due to air or other gasses out-gassing from the ink. In some cases, this causes a semi-permanent stray bubble of gas to be created in or migrate towards the inkjet chamber. Such a stray bubble may reside in the ink chamber. The presence of these stray bubbles within the ink chamber may affect the overall compressive condition of the ink. For example, the mechanical compliance of a stray bubble may absorb some of the internal pressure intended to displace ink out of the nozzle passage and delay the droplet release. Further, a stray bubble's wall may deflect the drive bubble away from the nozzle passage in such a manner that the droplet fails to form or forms more slowly.

In some examples, the ink flow from the reservoir may fail to establish a pressure equilibrium near the chamber's far wall and allow a residual bubble to remain in the ink chamber after the drive bubble has collapsed. In other examples, the ink may become frothy resulting in the formation of a plurality of miniature air bubbles in the liquid ink. The froth may be formed due to an air leak into the reservoir, a contaminant in the ink, an unintended mechanical agitation that mixes air from the nozzle passageway with the ink in the chamber, another mechanism, or combinations thereof. The froth may also be formed from a failed priming process that allows air to leak into the chamber as bubbles.

Due to the variety of effects that stray bubbles may have on a nozzle's health, the sensor may make inconsistent measurements. For example, frothy ink may measure as having a higher impedance value while in contact with the liquid ink due to some contact with the small air bubbles. In situations where a larger stray bubble is present, the liquid ink may fail to rewet the sensor's plate.

As will be explained in more detail below, these various issues will have differentiating characteristics as measured by the sensor (e.g. 205 in FIG. 2) in the ink chamber. For example, the life span of a drive bubble as measured by the sensor can indicate which, if any, of these various issues is occurring. Consequently, the output from that sensor can be used to determine which of the various issues described is occurring in a particular nozzle of the print head.

Figure 7:
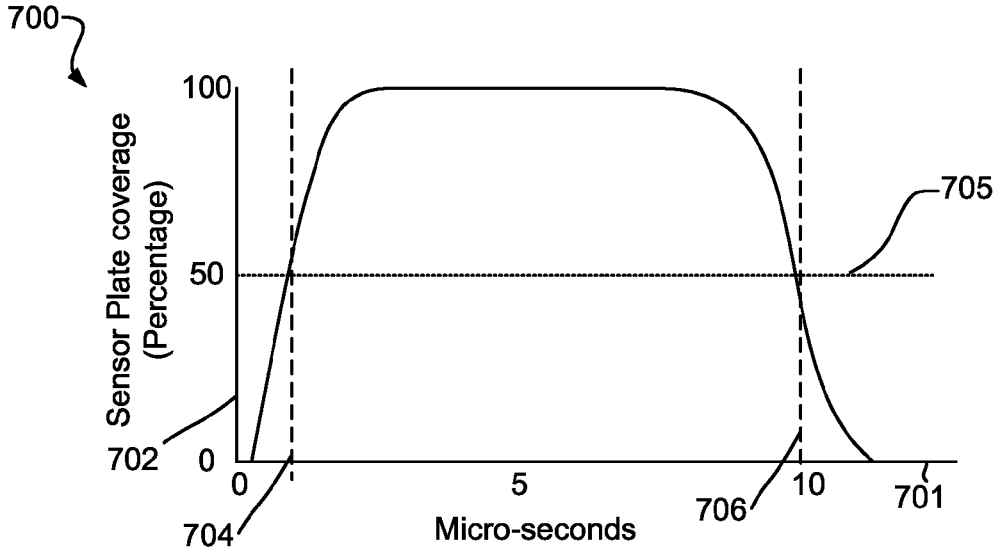
FIG. 7 is a diagram of an illustrative chart showing a bubble life span measured with a sensor, according to principles described herein.

FIG. 7 is an illustrative chart showing a bubble life span measured with a sensor, according to principles described herein. In this example, the x-axis (701) schematically represents time in microseconds. Zero microseconds may correspond to the initiation of the drive bubble formation. The y-axis (702) may schematically represent the drive bubble's coverage of the sensor plate's surface area, which corresponds to the impedance measurement. In this example, the chart shows a drive bubble that would result under healthy conditions.

The drive bubble's coverage depicted on the y-axis (702) may correspond to the impedance measurement taken by the sensor in the ink chamber over time. For example, a minimum impedance measurement may indicate that the entire surface area of the sensor is in contact with the ink and may correspond to zero percent surface area coverage on the y-axis (702). On the other hand, a maximum impedance measurement may indicate that the entire surface area of the sensor is in contact with the drive bubble and may correspond to a hundred percent surface area coverage on the y-axis (702). Impedance measurements between the minimum and maximum may indicate that a portion of the sensor's surface area is covered with liquid ink and another portion is covered by the drive bubble. In some examples, a higher impedance measurement indicates that a greater portion of the surface area is covered by the drive bubble. On the other hand, a lower impedance measurement may indicate that a majority of the surface area is a covered by liquid ink.

In the example of FIG. 7, the drive bubble formation time (704) is approximately one microsecond after the initiation of the drive bubble formation mechanism. In this example, zero microseconds indicates the time that the drive bubble formation mechanism is activated. However, a time lapse between the activation of the drive bubble formation mechanism, which may be schematically represented at zero on the x-axis (701), and the formation of the drive bubble may exist. For example, in situations where is a heater is used, there may be a time lapse due to the time it takes for the heater to reach a temperature sufficient to initiate a drive bubble formation. Also, in some examples, some ink may solidify on the surface of the heater from repeated exposure to high temperature. This solidified ink may be a thermal barrier that inhibits the heaters' ability to heat the surrounding liquid ink, which may result in a slower drive bubble formation time. In such an example, the drive bubble formation start time may change over the life of the nozzle and/or heater.

Further, in the example of FIG. 7, the drive bubble collapse time (706) is at approximately ten microseconds because the impedance value has dropped below the threshold value. In the example of FIG. 7, the impedance value that approximately equates to fifty percent plate coverage is used as the threshold level for indicating the presence or lack of presence of the drive bubble. However, in other examples, other threshold levels are used. For example, one to forty five percent sensor plate coverage may be used. In some examples, the threshold level is ten to twenty percent sensor plate coverage. In some examples, a threshold level above fifty percent coverage is used.

In some examples, the drive bubble collapse time changes over the life of the nozzle and/or drive bubble formation mechanism. As mentioned above, solidified ink on a surface of a drive bubble formation mechanism heater may affect the life of the drive bubble. Also, particles or stray bubbles may be introduced into the ink chamber that may semi-permanently reside in the ink chamber. While these particles or stray bubbles may not adversely affect an ink droplet release, they may affect the internal pressure of the ink chamber, which may change either the drive bubble formation time and/or the drive bubble collapse time.

Figure 8:
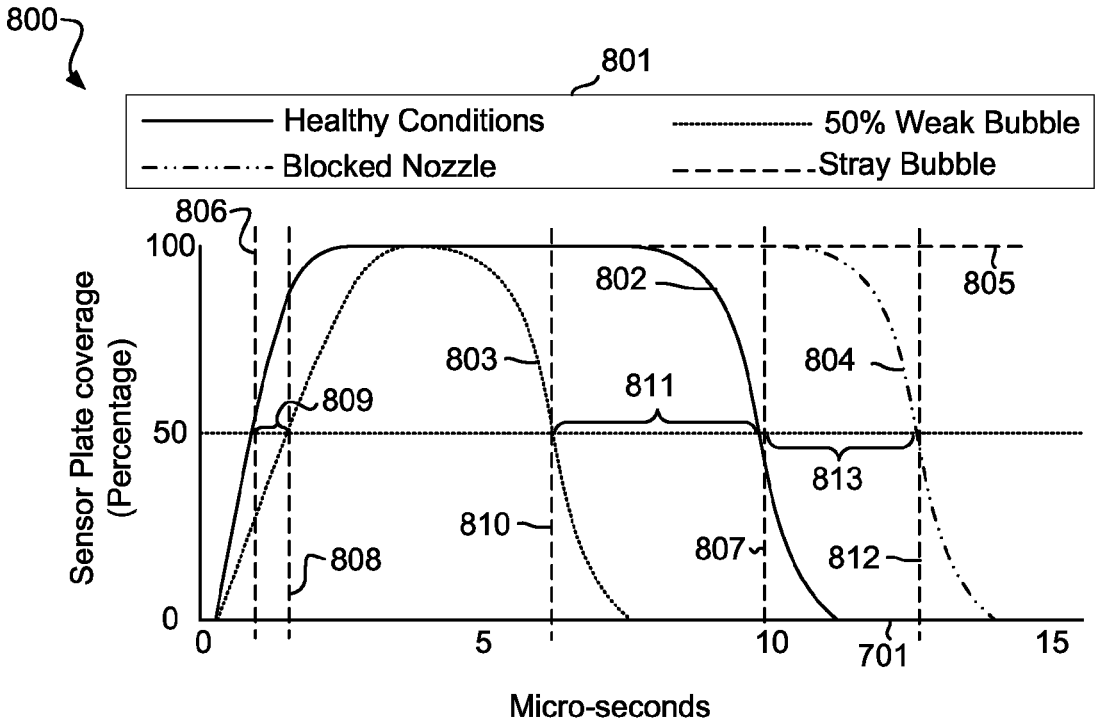
FIG. 8 is a diagram of an illustrative chart for detecting a nozzle health condition, according to principles described herein.

FIG. 8 is a diagram of an illustrative chart (800) for detecting a nozzle health condition, according to principles described herein. A legend (801) indicates which lines (802, 803, 804, 805) are associated with which conditions. In this example, drive bubble formation times and drive bubble collapse times of unhealthy inkjet nozzle conditions are determined based on the drive bubble formation time (806) and drive bubble collapse time (807) of a healthy nozzle condition schematically represented by line (802).

For example, experimental data may show that a weak drive bubble of fifty percent strength, schematically represented by line (803), has a drive bubble formation time (808) that is consistently delayed in a predictable manner from when a healthy drive bubble formation time (806) occurs. In the example of FIG. 8, the predictable manner may be a specific time duration (809) from the healthy condition's drive bubble formation time (806). In other examples, the predicable manner may be a specific mathematic relationship embodied in a mathematical equation or formula. Thus, the weak bubble's formation (808) time may be determined when the healthy condition's bubble formation time (806) is known.

In other examples, a bubble collapse time (810) of a weak bubble of fifty percent strength may also be determined based on a collapse time (807) of a healthy condition or based on a formation time (806) of a healthy condition. In the example of FIG. 8, the weak bubble's collapse time (810) is determined based on a time lapse (811) from the healthy condition's bubble collapse time (807). However, in other examples, the weak bubble's collapse time (810) is determined based on a mathematical relationship with either the healthy condition's drive bubble formation time (806) or collapse time (807).

Further, a bubble collapse time (812) of a blocked nozzle, such as a blocked nozzle outlet, which is schematically represented by line (804), may also be determined based on a collapse time (807) of the healthy condition or based on a formation time (806) of the healthy condition. In the example of FIG. 8, the blocked nozzle condition's collapse time (810) is determined based on a time lapse (813) from the healthy condition's bubble collapse time (807). However, in other examples, the blocked nozzle condition's collapse time (812) may be determined based on a mathematical relationship with either the healthy condition's drive bubble formation time (806) or collapse time (807).

In the example of FIG. 8, a stray bubble in contact with the impedance sensor is represented by line (805). In this example, the stray bubble's collapse time is not shown in the chart (800) because its collapse time is outside of the chart's time range. However, the stray bubble's collapse time may still be determined by a mathematical relationship or an experimentally derived time lapse with either the healthy condition's formation time (806) or collapse time (807).

Figure 9:
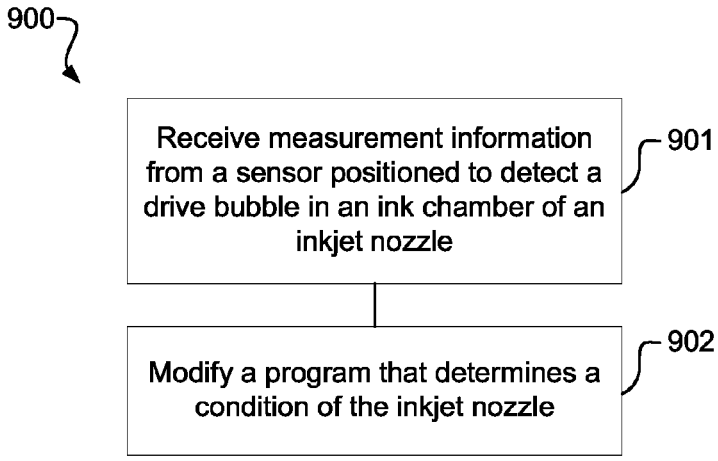
FIG. 9 is a diagram of an illustrative method for calibrating a nozzle health determiner program, according to principles described herein.

FIG. 9 is a diagram of an illustrative method (900) for calibrating a nozzle health determiner program, according to principles described herein. In this example, the method (900) includes receiving (901) measurement information from a sensor positioned to detect a drive bubble in an ink chamber of an inkjet nozzle and modifying (902) a program that determines a condition of the inkjet nozzle.

The program may be modified by determining parameters that the program uses for diagnosing a nozzle health condition. By way of illustration, the method may include determining the life span of a drive bubble so that the program may accurately decide whether a measurement that indicates a presence of a drive bubble indicates a healthy or unhealthy nozzle condition. An non-exhaustive list of parameters that the method (900) may determine includes a drive bubble formation time of a healthy nozzle, a drive bubble collapse time of a healthy nozzle, an impedance threshold measurement value for registering the existence or non-existence of a drive bubble, a blocked nozzle condition collapse time, a blocked nozzle condition formation time, a stray bubble collapse time, a stray bubble formation time, a weak bubble collapse time, a weak bubble formation time, or combinations thereof.

In some examples, the method determines whether the parameters should be universally applied to all nozzles on a print head, to a group of nozzles on a print head, to specific nozzles on a print head, or combinations thereof. In some examples, the impedance measurements received indicate that all of the drive bubble's life spans are close enough that using common parameters for each nozzle is appropriate. However, in some examples, the measurements indicate that at least one nozzle's drive bubble life span is different enough that a set of parameters unique for that nozzle should be determined.

The parameters may all be derived through experimental data. In some examples, just some of the data is derived through experimental data, such as just the drive bubble collapse and/or formations times, and the rest of the parameters are determined based on a time relationship or mathematical relationship to this experimentally determined data.

Figure 10:
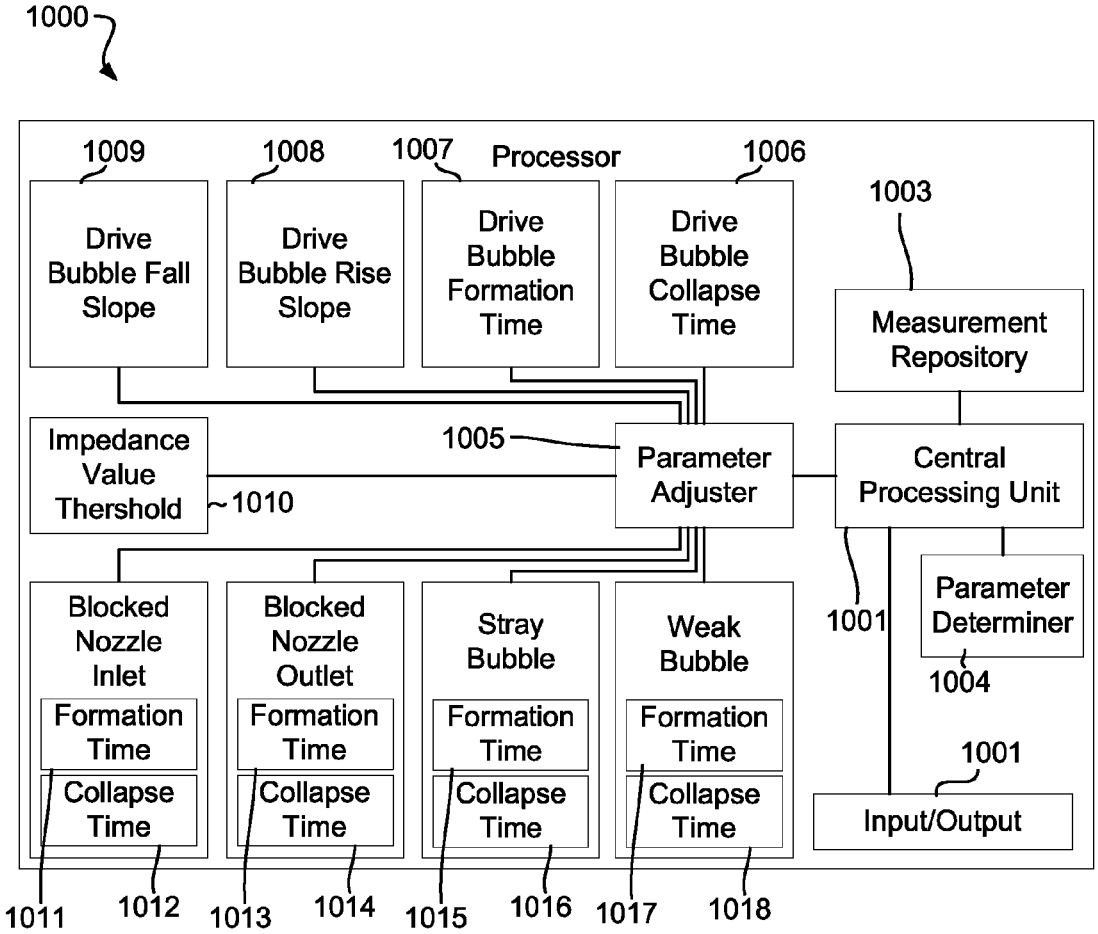
FIG. 10 is a diagram of an illustrative processor, according to principles described herein.

FIG. 10 is a diagram of an illustrative processor (1000), according to principles described herein. In this example, the processor (1000) is located in the printer, but off of the print head. The processor (1000) may receive measurements from a drive bubble detection system incorporated in the print head. The detection system may send impedance measurement values and the respective times when the measurements were taken.

In some examples, a processor (1000) is dedicated to a single print head or a group of print heads. In other examples, the processor (1000) is dedicated to a single nozzle or a group of nozzles on a single print head or on different print heads.

The processor (1000) may have an input/output (1001) that is in communication with a central processing unit (CPU) (1002). The input/output (1001) may send the measurement information and their respective times to the CPU (1002) upon receipt of the information. In some examples, the processor (1000) sends a request to the print head or nozzles that contain the measurements. In some examples, a nozzle sends the information to the processor (1000) without request.

The CPU (1002) may store the data in a measurement repository (1003). The measurement repository may have a look-up table associated with each nozzle and/or print head in communication with the processor (1000).

The processor (1000) may be in communication with a nozzle health determiner program associated with the nozzles and/or print heads with whom the processor (1000) is in communication. In some examples, the program is a single program that determines the health of each nozzle. In other examples, the program is in communication with a limited number of nozzles. In other examples, the processor (1000) is in communication with multiple programs that determine the health of different nozzles.

In the illustrated example, the CPU (1002) is in communication with a parameter determiner (1004) that may be programmed to determine the parameters that the nozzle health determiner program uses to determine the health of the nozzles. In this example, the CPU (1002) supplies the parameter determiner (1004) with the measurement information received for each nozzle.

In some examples, the parameter determiner (1004) notifies a parameter adjuster (1005) through the CPU (1002) once a parameter has been determined. In some examples, the parameter adjuster (1005) is just notified if the parameter determiner (1004) determines that a parameter is different than what the program is currently using.

The parameter determiner (1004) may determine parameters based on the impedance value measurements and their associated times as measured from the activation of the drive bubble formation mechanism. In some examples at least one of the parameters is determined based on a time relationship or a mathematical relationship to a parameter that is determined directly from the impedance values and their respective measurement times.

The program adjuster (1005) may be in communication with memory tables that store the parameters determined by the parameter determiner (1004). A non-exhaustive list of parameter memory tables may include a drive bubble collapse time table (1006) under a healthy nozzle operating conditions, a drive bubble formation time table (1007) under healthy nozzle operating conditions, a drive bubble rise slope table (1008) under healthy nozzle operating conditions, a drive bubble fall slope table (1009) under healthy nozzle operating conditions, an impedance value threshold table (1010), a blocked nozzle inlet formation time table (1011), a blocked nozzle inlet collapse time table (1012), a blocked nozzle outlet formation time table (1013), a blocked nozzle outlet collapse time table (1014), a stray bubble formation time table (1015), a stray bubble collapse time table (1016), a weak bubble formation time table (1017), a weak bubble collapse time table (1018), other tables, or combinations thereof.

Figure 11:
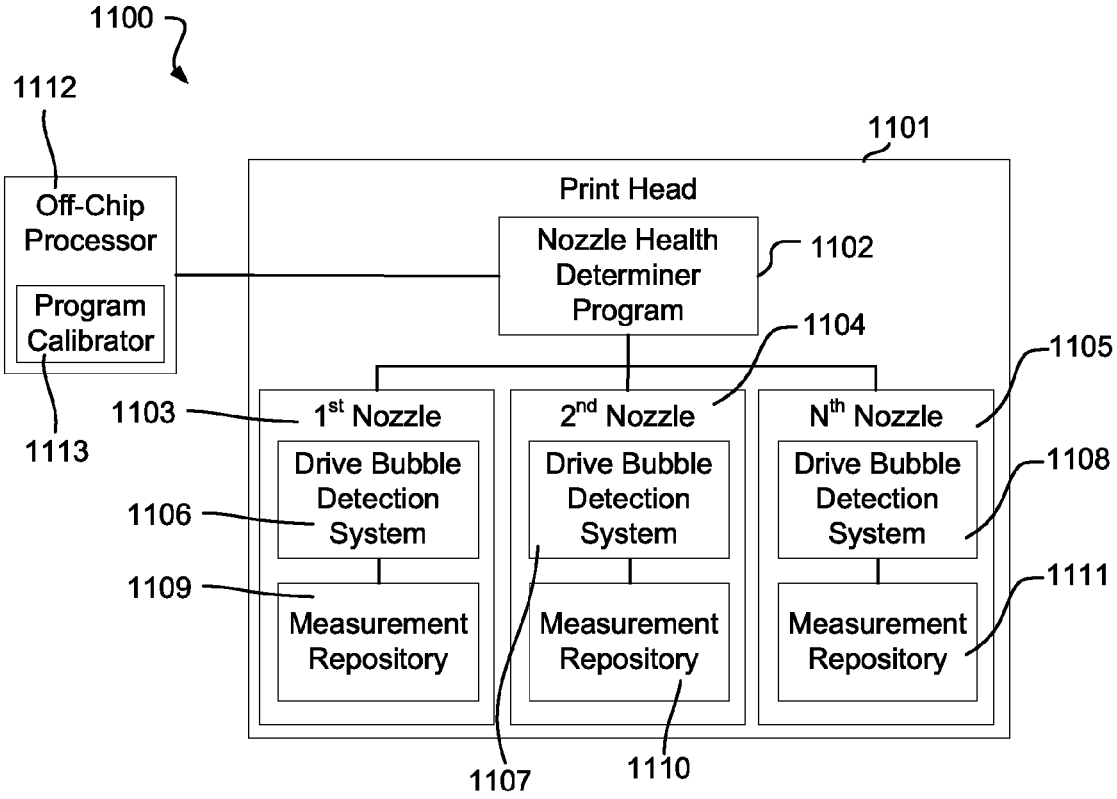
FIG. 11 is a diagram of illustrative circuitry for calibrating a program, according to principles described herein.

FIG. 11 is a diagram of illustrative circuitry (1100) for calibrating a program, according to principles described herein. In this example, a print head (1101) has a nozzle health determiner (1102) in communication with a first nozzle (1103), a second nozzle (1104), and up to an $N^{th}$ nozzle (1105). Each of the nozzles (1103, 1104, 1105) may have drive bubble detection systems (1106, 1107, 1108) and measurement repositories (1109, 1110, 1111). The detection systems (1106, 1107, 1108) may detect the presence of a drive bubble in an ink chamber associated with their respective nozzles (1103, 1104, 1105) by taking impedance measurements. These measurements may be stored in their nozzle's respective repositories (1109, 1110, 1111).

The nozzle health determiner program (1102) may use the measurements to determine whether one of the nozzles has a healthy or unhealthy condition. The nozzle health determiner program (1102) may use parameters to determine the nozzles' health condition. For example, if a nozzle health determiner program (1102) has a parameter that indicates that the blocked nozzle outlet has a collapse time of ten microseconds, and the measurements indicate the presence of a drive bubble before ten microseconds and the non-existence of a drive bubble after ten microseconds, then the program (1102) may determine that the nozzle has a blocked nozzle outlet.

The print head (1101) may send the measurements and/or other information stored in the repositories (1109, 1110, 1111) to an off-chip processor (1112). In some examples, the nozzles send the information to the off-chip processor (1112) upon receipt of the information, at periodic time intervals, upon a triggering event, upon request, or combinations thereof.

In some examples, the off-chip processor (1112) requests the information from the repositories (1109, 1110, 1111). In such examples, the nozzles may send the off-chip processor (1112) the latest version of the information.

The off-chip processor (1112) may have a program calibrator (1113) that determines the parameters for the program (1102) to use. Once the parameters are determined, the program calibrator (1113) may load the determined parameters into the program (1102).

In some examples, just select impedance measurements are stored in the repositories (1109, 1110, 1111). For example, a periodic calibration sequence may cause the nozzles to fire and measurements to be taken. These measurements may be stored for processing purposes. In some examples, health determination measurements are not stored in the repositories (1109, 1110, 1111) with the calibration measurements.

However, in some examples, the off-chip processor (1112) may determine when a measurement indicates an unhealthy condition and disregard its measurements from the calibration process. For example, if a measurement for a particular nozzle is sent to the off-chip processor (1112) that is substantially different that what the off-chip processor (1112) has previously received for that particular nozzle, the off-chip processor (1112) may disregard those measurements. In some examples, if the off-chip processor (1112) disregards measurements because the measurements indicate an unhealthy condition, the off-chip processor (1112) may use previous measurements of the same nozzle or measurements from different nozzles to calibrate the program (1102) for that particular nozzle.

In some examples, the off-chip processor (1112) calibrates the program (1102) for at least a group of the nozzles based on a single nozzle's measurements. In some examples, the off-chip processor analyzes the measurements received and determines if a single set of measurements may be used to calibrate the program for all of the nozzles. In some examples, the off-chip processor (1112) determines that specific nozzles or groups of specific nozzles should have different parameters than other nozzles. In such examples, the off-chip processor (1112) may determine to customize parameters of the program for specific nozzles.

In some examples, the off-chip processor (1112) determines under what conditions the drive bubble detection systems (1106, 1107, 1108) takes calibration measurements. In some examples, the calibration measurements are made while the print head (1101) is still being manufactured. In other examples, the selected conditions include taking calibration measurements before a planned event, during a print job, after a print job, before a print job, or combinations thereof.

The off-chip processor (1112) determines other factors about when and how the calibration measurements are taken as well as how the nozzle health determination measurements are taken. For example, the off-chip processor (1112) may determine the impedance value threshold level for determining the presence or non-presence of the drive bubble for both the calibration measurements and health determination measurements. In some examples, the impedance value threshold level is the same for the calibration measurements and the health determination measurements. However, in other examples, the threshold level is different for measurements intended for different purposes.

In some examples, the measurements are taken during a print job to determine the health of the nozzle include measurements that are easy to calculate because the aim of these measurements is to determine in real time whether an unhealthy condition exists and to make remedial action quickly if appropriate. The objectives of these measurements may be better achieved with measurements at a higher impedance threshold level, fewer measurements, and/or other conditions. Further, due to the quick response needed for real time detection, the drive bubble detection circuitry may be located in the print head, where circuitry space may be limited. Thus, the circuitry for performing real time measurements may be limited to just needed calculations. On the other hand, the calibration measurements may be taken when real time calculations are not needed. The calibration processing may take place off of the print head chip where circuitry space is more abundant. Since calibration measurements may not be subject to the same real time processing criteria that the health determination measurements are, the calibration measurements may be taken with a greater resolution and their calculations may take longer to process.

In some examples, the off-chip processor (1112) determines the characteristics of a drive bubble under healthy conditions and modifies the program to efficiently operate given the drive bubble's characteristics. For example, the program calibrator (1113) may modify the program (1102) to take measurements at just specific times, like when a drive bubble formation or collapse is expected to occur, during the health determination measurements.

During the first calibration process, many measurements may be taken over the life span of the drive bubble for accuracy. However, after the program (1102) has been calibrated once, further calibrations measurements may be simplified. For example, during a calibration process, the drive bubble formation time and collapse time may be stored in the off-chip processor (1112). As a consequence, future calibration measurements may be taken to merely confirm that the drive bubble formation and collapse times are still accurate. In other examples, calibration measurements are taken within just a time window of when the drive bubble formation time and/or collapse time are approximately expected. Thus, calibration measurements may be taken at just the times that the useful information is expected to be retrieved. In this manner subsequent calibration processes may be less expensive to perform.

While the principles herein have been described with specific ink chamber geometries, drive bubble formation mechanism placements, and sensor placements, any placement of components within or around the ink chamber and any geometry of the ink chamber are included within the scope of the principles described herein.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A method for calibrating a program that detects a condition of an inkjet nozzle, comprising:

receiving measurement information from a sensor positioned within an ink chamber to detect a drive bubble in said ink chamber of an inkjet nozzle;

determining a bubble formation time and a bubble collapse time based on the received measurement information; and modifying a program that determines a condition of said inkjet nozzle based on the determined bubble formation time, bubble collapse time, or combinations thereof.

2. The method of claim 1, wherein modifying a program that determines a condition of said inkjet nozzle includes determining a drive bubble formation time.

3. The method of claim 1, wherein modifying a program that determines a condition of said inkjet nozzle includes determining a drive bubble collapse time.

4. The method of claim 1, wherein modifying a program that determines a condition of said inkjet nozzle includes determining an impedance threshold value for detecting said drive bubble with said sensor.

5. The method of claim 1, wherein modifying a program that determines a condition of said inkjet nozzle includes determining a blocked nozzle condition collapse time based on said measurement information.

6. The method of claim 1, wherein modifying a program that determines a condition of said inkjet nozzle includes determining a stray bubble collapse time based on said measurement information.

7. The method of claim 1, wherein modifying a program that determines a condition of said inkjet nozzle includes determining a weak bubble collapse time based on said measurement information.

8. The method of claim 1, wherein modifying a program that determines a condition of said inkjet nozzle includes determining to customize parameters of said program for other nozzles incorporated into a common print head with said inkjet nozzle.

9. The method of claim 1, where said measurement information comprises an impedance measurement.

10. A printer comprising:

a detection system within an ink chamber in said printer comprising a sensor proximate to a heater, the sensor positioned to detect a presence of a drive bubble in said ink chamber associated with a nozzle;

a processor in communication with said detection system;

said processor programmed to:

receive measurement information from said detection system;

determine a bubble formation time and a bubble collapse time based on the received measurement information; and modify a program that runs said detection system based on the determined bubble formation time, bubble collapse time, or combinations thereof.

11. The printer of claim 10, wherein said processor programmed to modify a program that runs said detection system based on said measurement information includes determining a drive bubble formation time and a drive bubble collapse time under healthy nozzle operating conditions.

12. The printer of claim 10, wherein said processor programmed to modify a program that runs said detection system based on said measurement information includes determining a drive bubble formation time and a drive bubble collapse time under at least one unhealthy nozzle operating condition.

13. The printer of claim 12, wherein said at least one unhealthy nozzle operating condition includes a blocked nozzle outlet, a blocked nozzle inlet, a weak drive bubble formation, a presence of a weak stray bubble, or combinations thereof.

14. A computer program product, comprising:

a tangible computer readable storage medium, said computer readable storage medium comprising computer readable program code embodied therewith, said computer readable program code comprising:

computer readable program code to receive measurements from a drive bubble detection system that comprises a metallic plate impedance sensor; and computer readable program code to modify a program that runs said bubble detection system.

15. The computer program product of claim 14, wherein said computer readable program code to modify a program that runs said bubble detection system includes inputting into said program an adjusted bubble formation time or an adjusted bubble collapse time.

16. The method of claim 1, further comprising determining the life span of a drive bubble to indicate an unhealthy nozzle condition.

17. The method of claim 1, further comprising storing impedance measurement information in a measurement repository.

18. The method of claim 1, wherein the drive bubble is detected based on a percentage of the sensor that is in contact with the drive bubble.

19. The printer of claim 10, wherein said detection system further comprises a ground element located within the ink reservoir.

20. The printer of claim 10, wherein said processor programmed to modify a program that runs said detection system based on said measurement information includes excluding measurements taken under unhealthy nozzle operating conditions.

* * * * *